United States Patent [19]

Jackson

[11] 4,027,649

[45] June 7, 1977

[54] COMBINED WOOD BURNING STOVE AND FIREPLACE

[76] Inventor: J. D. Jackson, 38751 Camp Creek Road, Springfield, Oreg. 97477

[22] Filed: Oct. 30, 1975

[21] Appl. No.: 627,245

[52] U.S. Cl. ..... 126/4; 126/62; 126/202; 126/218; 312/325

[51] Int. Cl.[2] ..... F24C 1/14; F24C 15/36

[58] Field of Search ..... 126/58, 60, 62, 63, 126/67, 138, 4, 1 R, 1 AB, 1 AC, 143, 202, 216, 218; 312/325, 328; 237/52; 49/485

[56] References Cited

UNITED STATES PATENTS

| | | | |
|---|---|---|---|
| 1,127,575 | 2/1915 | Arndt | 126/58 |
| 1,713,782 | 5/1929 | Simons | 126/67 |
| 1,759,619 | 5/1930 | Hutchinson, Jr. | 126/202 X |
| 2,211,257 | 8/1940 | Deisley et al. | 49/485 |
| 2,467,577 | 4/1949 | Baldwin | 126/67 |
| 2,983,367 | 5/1961 | Parmater et al. | 312/328 |
| 3,880,139 | 4/1975 | Young | 126/62 X |
| D237,798 | 11/1975 | Fisher | D23/97 X |

FOREIGN PATENTS OR APPLICATIONS

| | | | |
|---|---|---|---|
| 351,021 | 3/1922 | Germany | 126/1 R |

*Primary Examiner*—William E. Wayner
*Assistant Examiner*—William E. Tapolcai, Jr.
*Attorney, Agent, or Firm*—Clarence A. O'Brien; Harvey B. Jacobson

[57] ABSTRACT

A metal housing is provided including interconnected opposite side, front, rear, top and bottom walls and the front wall is provided with a large opening formed therein whose upstanding side edges are spaced inwardly of the adjacent sidewalls. A pair of opposite side closure doors are hingedly supported from opposite side portions of the front wall and are swingable horizontally between coplanar positions closing the large opening with their free swinging edges in close juxtaposition and open positions with the doors swung outwardly and rearwardly into positions closely paralleling the outer surfaces of the forward portions of the side walls. The top wall includes front and rear portions and the rear portion of the top wall has a flue outlet opening formed therein. The front wall is provided with a horizontally outwardly projecting hearth spaced slightly below the lower marginal edge portion of the large front wall opening and an upright screen structure is provided with forwardly projecting legs and positionable on the hearth with the engagement of the legs of the screen structure with the hearth maintaining the screen structure in close juxtaposition with the outer surfaces of the front wall extending about the large opening, the hearth including a raised curb extending about its outer periphery and the legs of the screen structure being spaced closely inwardly of adjacent portions of the curb when the screen structure is disposed on the hearth.

12 Claims, 7 Drawing Figures

4
7
7
4
12
14
16
18
22
24
26
30
32
34
36
38
40
42
76
78
80
82
84
86
88
90

COMBINED WOOD BURNING STOVE AND FIREPLACE

BACKGROUND OF THE INVENTION

Various forms of combined free-standing stoves and fireplaces have been heretofore designed. Such previously known structures have provided only two functions, that of a stove and a fireplace. Examples of stove and fireplace structures including some of the basic structural features of the instant invention are disclosed in U.S. Pat. Nos. 43,314, 3,213,846, 370,580, 3,809,051 and 3,880,139.

BRIEF DESCRIPTION OF THE INVENTION

The combined stove and fireplace of the instant invention is in the form of a generally rectangular housing provided with depending supportive legs and the front wall of the housing has an access opening formed therein with which horizontally swingable doors are operatively associated for closing the opening. The doors are also swingable to fully open positions disposed closely outwardly of the outer surfaces of the forward ends of the side walls of the housing. The rear portion of the top wall of the housing has a flue outlet formed therein and the inner surfaces of the bottom wall and the lower portions of the rear and opposite side walls are lined with a fireproof material. Still further, an upstanding baffle is supported from the rear wall of the housing in spaced relation relative thereto in order to define an open top and bottom convection air passage at the rear of the housing and the upper rear corners of the housing include support plates adjustably supported therefrom in spaced relation relative to the top wall of the housing and which may be used as warming plates, the front and rear portions of the top wall of the housing being disposed at different levels and comprising cooking surfaces.

The main object of this invention is to provide a combined stove and fireplace of the free-standing type and which may utilize various types of fuel.

Another object of this invention is to provide an assemblage in accordance with the preceding object and whose lower portion is sufficiently insulated to enable a wood fire therein to burn continuously for up to 8 hours without adding additional wood thereto.

Still another important object of this invention is to provide a combined stove and fireplace having exterior convection air passage means operatively associated therewith whereby the flow of convention air passing heated surfaces of the combined fireplace and stove will be enhanced to thereby enable more complete and rapid dissipation of heat generated by the combined stove and fireplace to the interior of a room in which the combined stove and fireplace is situated.

A further object of this invention is to provide an apparatus in accordance with the preceding objects and including a two-level top wall with the levels thereof spaced different distances from the lower firebox area of the stove so as to provide cooking surfaces of different temperatures.

Another important object of this invention is to provide a combined stove and fireplace including a horizontally forwardly projecting hearth spaced below the front opening and a screen structure positionable on the hearth to close the front opening when the doors thereof are in the open position, the screen structure being constructed of 22-gauge steel and having air openings defined therethrough representing only 20% of the total area of the screen construction for safety and heat retention.

Yet another object of this invention is to provide a combined stove and fireplace including a flue outlet disposed at an elevation appreciably above the upper marginal portion of the front opening of the combined stove and fireplace.

Another important object of this invention is to provide the front wall and closable doors of the combined stove and fireplace with novel air and smoke seal structure.

A final object of this invention to be specifically enumerated herein is to provide a combined stove and fireplace structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 5, 6:
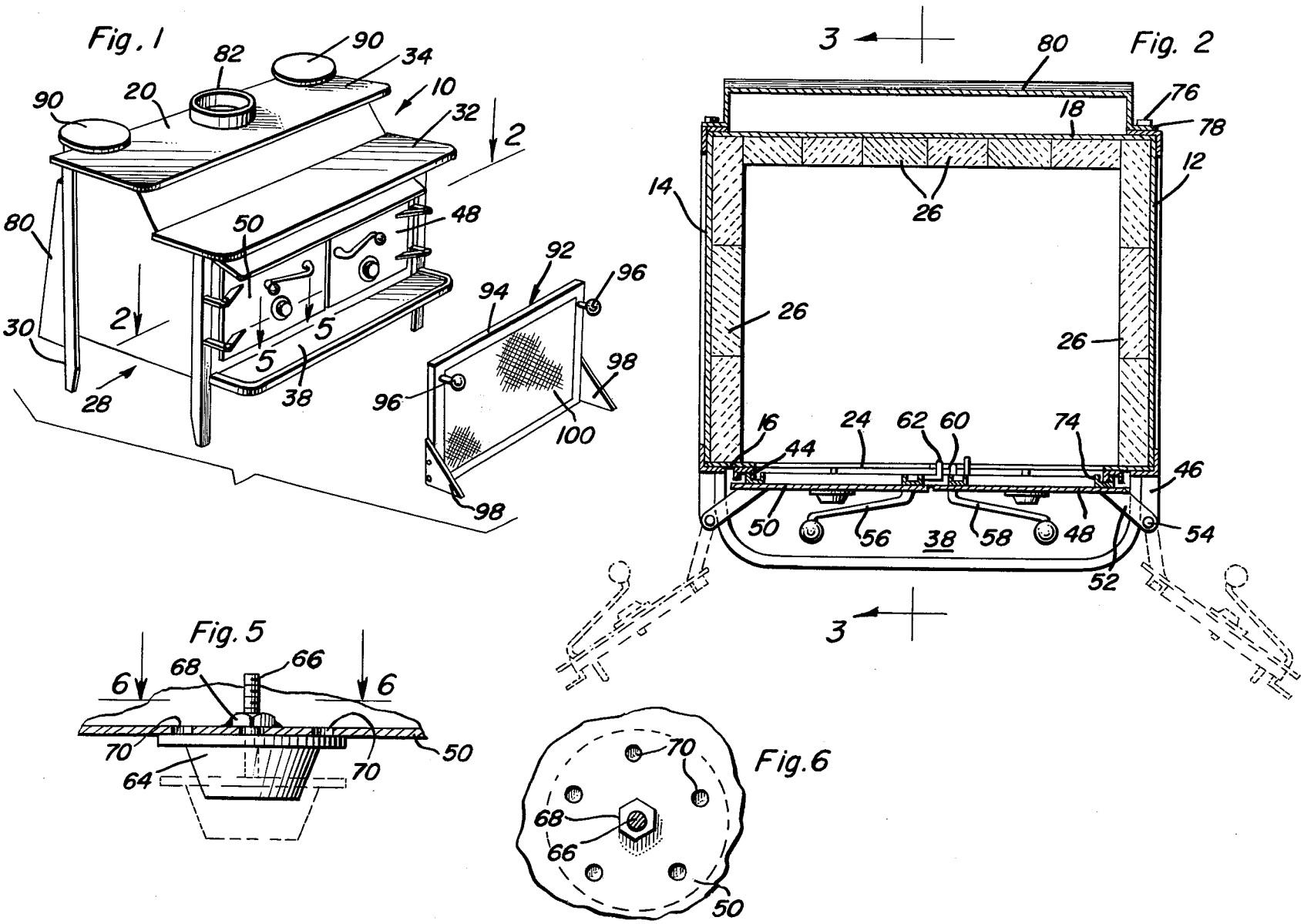
FIG. 1 is a perspective view of the combined stove and fireplace of the instant invention with the screen structure thereof in an exploded position.
FIG. 2 is an enlarged fragmentary horizontal sectional view taken substantially upon the plane indicated by the section line 2—2 of FIG. 1 and with partially open positions of the doors illustrated in phantom lines.
FIG. 5 is an enlarged fragmentary horizontal sectional view taken substantially upon the plane indicated by the section line 5—5 of FIG. 1.
FIG. 6 is a fragmentary vertical sectional view taken substantially upon the plane indicated by the section line 6—6 of FIG. 5.

Referring now more specifically to the drawings, the numeral 10 generally designates the combined stove and fireplace structure of the instant invention. The structure 10 includes generally parallel opposite side walls 12 and 14 interconnected by means of upstanding front and rear walls 16 and 18 and top and bottom walls 20 and 22. The front wall 16 has a large front opening 24 formed therein a spaced distance above the bottom wall 22 and the bottom wall 22 and the lower portions of the opposite side walls 12 and 14 and the rear wall 18 are lined with fire bricks 26.

The four lower corners of the housing 28 defined by the opposite side walls 12 and 14, the front and rear walls 16 and 18 and the top and bottom walls 20 and 22 include depending support legs 30 and it will be noted that the support legs 30 comprise angle irons and extend upwardly along the corresponding corner portions of the housing 28 in order to reinforce those corner portions. Further, the top wall 20 includes front and rear lower and upper sections 32 and 34 and a rearwardly and upwardly inclined intermediate section 36 interconnects the front and rear marginal portions of the upper and lower sections 34 and 32.

The front wall includes a horizontally outwardly projecting and substantially full width hearth 38 spaced below the opening 24 and in general horizontal registry with the bottom wall 22. The hearth 38 includes an upwardly projecting curb 40 extending about its outer periphery and a downwardly and outwardly inclined transverse eyebrow-defining plate 42 is supported from the upper portion of the front wall 16 at an elevation spaced between the section 32 of the top wall 20 and the upper marginal portion of the opening 24.

The forward outer surface of the front wall 16 includes an outwardly opening channel member 44 extending peripherally about the opening 24 and the forward legs 30 each support forwardly projecting vertically spaced mounts 46 at opposite sides of the opening 24. A pair of doors 48 and 50 are provided and include outwardly projecting inclined support arms 52 whose free ends are pivotally supported from the forward ends of the corresponding mounts 46 by means of pivot fasteners 54. Accordingly, the doors 48 and 50 may be swung from the fully closed positions thereof illustrated in FIGS. 1, 2 and 3 of the drawings to the partially open phantom line positions thereof illustrated in FIG. 2 and further to fully open positions with the doors 50 and 52 spaced outwardly of the forward portions of the side walls 12 and 14. The door 50 includes a fixed handle 56 and the door 48 includes an oscillatable handle 58 including an inner portion 60 removably engageable with a catch 62 to maintain the doors 48 and 50 in the closed positions.

Each of the doors 48 and 50 includes a center damper knob 64 threadedly supported therefrom by means of an integral threaded shank portion 66 threaded through a nut 68 secured to the inner surface of the corresponding door. Each door 48 and 50 has a plurality of draft air openings 70 formed therein in a circular pattern about the corresponding shank 66 and it will be noted from FIG. 5 of the drawings that each of the knobs 64 may be threaded inwardly in order to close the draft openings 70. Of course, when the knobs 64 are threaded outwardly, the draft air openings 70 are opened to allow the passage of draft air into the interior of the housing 28.

Each of the doors 48 and 50 includes an inwardly opening peripheral channel member 74 interlockingly engageable with the corresponding portions of the channel member 44 whereby a reasonably good airtight seal is defined between doors 48 and 50 and the front wall 16 when the doors 48 and 50 are in the closed positions. Of course, if a fire exists within the housing 28 any slight leakage of air between the doors 48 and 50 and the front wall 16 constitutes inwardly moving draft air.

The upper portions of the rear legs 30 include rearwardly outwardly projecting headed studs 76 with which notched mounting ears 78 carried by opposite sides of a forwardly opening upstanding channel member 80 are removably engageable for support of the channel member 80 from the rear wall 18 of the housing 28. The lower end of the channel member 80 extends below the bottom wall 22 and the upper end of the channel member 80 terminates approximately 1 inch below the upper section 34 of the top wall 20. However, the channel member 80 extends substantially the full width of the rear wall 18 and defines a convection air passage extending upwardly along the outer surface of the rear wall 18. Accordingly, convection air is drawn inwardly into the bottom of the air passage defined by the channel member and discharged from the upper end of the passage after having been heated by the rear wall 18.

The central portion of the upper section 34 of the top wall 20 includes a flue outlet opening therein defined by a sleeve 82 secured through the upper section 34. The lower end of a flue pipe 84 is telescoped over the sleeve 82.

Figures 3, 4, 7:
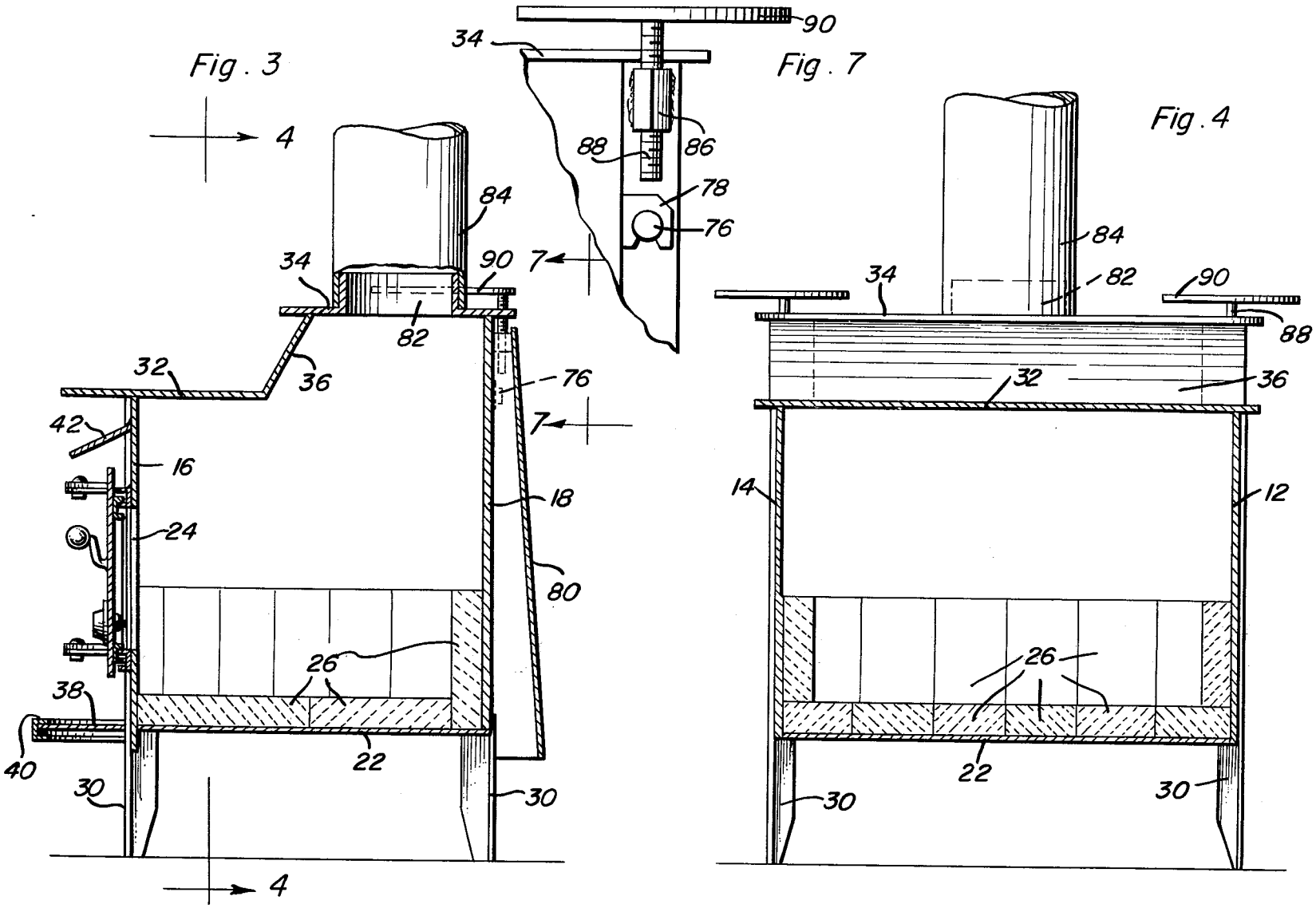
FIG. 3 is a vertical sectional view taken substantially upon the plane indicated by the section line 3—3 of FIG. 2.
FIG. 4 is a vertical sectional view taken substantially upon the plane indicated by the section line 4—4 of FIG. 3.
FIG. 7 is a rear elevational view of one upper corner portion of the combined stove and fireplace illustrating the manner in which a cooking utensil heating plate is supported fron the upper rear portion of the stove for vertical adjustment relative thereto.

With attention invited now more specifically to FIG. 7 of the drawings, it may be seen that the upper ends of the rear legs 30 include threaded sleeves 86 in which depending threaded shank portions 88 carried by a pair of horizontal support plates 90 are threadedly engaged. The support plates 90 are generally circular in plan shape and the shank portions 88 are eccentric with the plates 90. Of course, the elevation of the plates 90 in relation to the upper section 34 of the top wall 20 may be varied and cooking containers may be placed upon the plates 90 in order to keep warm after having been used to cook on either the lower or upper sections 32 and 34 of the top wall 20.

It will be noted that the upper marginal portion of the opening 24 is spaced appreciably below the lower section 32 of the top wall 20 and that the flue outlet sleeve 82 is secured through the upper section 34 of the top wall 20 which is elevated appreciably above the lower forward section 32. Accordingly, draft air within the housing 28 is highly efficient and no smoke will exit from the housing 28 beneath the upper marginal edge portion of the opening 24 even when the doors 48 and 50 are in open positions.

With attention now invited more specifically to FIG. 1, there will be seen an upstanding rectangular screen structure referred to in general by the reference numeral 92. The screen structure 92 includes a peripheral frame 94 having opposite side upper heat insulative support knobs 96 supported therefrom and lower opposite side triangular support legs 98 supported from opposite side lower portions of the frame 94 and projecting forwardly thereof. The screen structure 92 is positionable on the hearth 38 with the frame 94 abutted against the outer surfaces of the front wall 18 extending about the opening 24 when the doors 48 and 50 are in the open positions thereof. When the screen structure 92 is disposed on the hearth 38, the extreme forward portions of the legs 98 are spaced closely inwardly of adjacent portions of the curb 40. Accordingly, the curb 40 serves to limit forward displacement of the screen structure 92 away from the front wall 16 and also to limit lateral shifting of the screen structure 92 relative to the opening 24.

When the structure 10 is to be used as a fireplace, the doors 48 and 50 are opened and a wood or other fire may be started within the housing 28. Then, the screen structure 92 is placed in position across the opening 24. The screen structure 92 includes a screen mesh or foraminated panel 100 extending across the frame 94 with the openings therethrough occupying only about 20% of the total area thereof. In this manner, when wood or another fuel is being burned in the housing 28, a considerable quantity of heat is retained therewithin enabling a wood fire to burn for up to 8 hours without the need for adding additional wood. Of course, the screen structure 92 may be removed and the doors 48 and 50 may be closed in order to enable the housing 28 to be used as a stove. Both the forward and upper sections 32 and 34 of the top wall 20 may be used as a cooking surface and after a particular dish has been cooked, the container thereof may be placed on one of the plates 90 in order to be kept warm.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A combined stove and fireplace assembly including a housing having interconnected opposite side, front, rear, and top and bottom walls, said front wall having a large opening formed therein whose upstanding side edges are spaced inwardly of said side walls, a pair of opposite side closure doors hingedly supported from opposite side portions of said front wall and swingable horizontally between coplanar positions closing said opening with their free swinging edges in close juxtaposition and open positions with said doors swung outwardly and rearwardly into position closely paralleling the outer surfaces of the forward portions of said side walls, a rear portion of said assembly having a flue outlet opening formed therein, said front wall including a horizontally outwardly projecting hearth spaced slightly below the lower marginal poertion of said large opening, an upright screen structure having front and rear sides and support legs including at least portions thereof spaced forward of the opposite side marginal portions of said screen structure, said screen structure, including said legs being removably positionable on said hearth with the periphery of said screen structure at least closely juxtaposition the outer surfaces of said front wall extending about said large opening, said hearth including a raised curb extending about its outer periphery, said curb including opposite end inwardly curving portions, said legs being closely embraced by said inwardly curving portions of said curb when said screen structure is disposed on said hearth, whereby said inwardly curving curb portions serve to limit forward displacement and lateral shifting of said legs, and thus said screen structure, relative to said large opening.

2. The combination of claim 1 wherein said bottom wall and the lower portions of said rear and side walls include fireproof materials lining their inner surfaces.

3. The combination of claim 1 wherein said doors include draft air openings formed therethrough and damper means operative to selectively close said draft air openings.

4. The combination of claim 1 wherein said front and rear portions of said top wall comprise low and higher elevation portions whose rear and front marginal portions are interconnected by means of a rearwardly and upwardly inclined intermediate portion, said rear portion of said top wall having said flue opening therein.

5. The combination of claim 4 wherein said housing includes a warming plate supported therefrom for vertical adjustment relative thereto and positioned in spaced relation above at least one rear corner portion of said higher elevation portion of said top wall.

6. The combination of claim 1 wherein said front wall includes a downwardly inclined eyebrow spaced above and extending along the upper marginal edge of sid large opening.

7. The combination of claim 1 wherein said front wall includes an outwardly opening channel member extending about said large opening, said doors including inwardly opening peripheral channel portions interdigitated with said channel member when said doors are in the closed positions thereof.

8. The combination of claim 4 including a convection air passage defining plate generally paralleling and supported from said rear wall in spaced relation rearwardly thereof, the lower end of said plate projecting downwardly below said bottom wall.

9. The combination of claim 8 wherein said plate is slightly upwardly convergent toward said rear wall and includes forwardly directed flanges closing the opposite sides of the convention air passage defined between said plate and said rear wall.

10. The combination of claim 9, includng a horizontal warming plate provided at each rear corner of said top wall including an eccentrically disposed depending threaded support shank threadedly supported from the corresponding rear corner portion of said assembly, said plates being vertically threadedly adjustable relative to said assembly and selectively swingable between positions substantially vertically registered with adjacent portions of said top wall, substantially fully out of vertical registry with said top wall and in vertical registry with the adjacent corresponding side portions of the upper discharge end of said convection air passage.

11. A combined stove and fireplace assembly including a housing having interconnected opposite, side, front, rear and top and bottom walls, said front wall having a large opening formed therein, a closure shiftably supported from said housing into and out of closing relation with said opening, a horizontal warming plate provided at each rear corner of said top wall including an eccentrically disposed depending threaded support shank threadedly supported from the corresponding rear corner portion of said assembly, said plates being vertically threadedly adjustable relative to said assembly and selectively swingable between positions substantially fully vertically registered with adjacent portions of said top wall and substantially fully out of vertical registry with said top wall.

12. The combination of claim 11 including a convection air passage defining plate generally paralleling and supported from said rear wall in spaced relation rearwardly thereof, the lower end of said plate projecting downwardly below said bottom wall, said warming plates also being swingable inwardly toward each other in vertical registry with the adjacent corresponding side portions of the upper discharge end of said convection air passage.

* * * * *